US010358621B2

(12) United States Patent
Kropf et al.

(10) Patent No.: US 10,358,621 B2
(45) Date of Patent: Jul. 23, 2019

(54) DISHWASHER DETERGENT CONTAINING METAL COMPLEXES

(71) Applicant: Henkel AG & Co. KGaA, Dusseldorf (DE)

(72) Inventors: Christian Kropf, Hilden (DE); Nadine Bluhm, Duesseldorf (DE); Inga Kerstin Vockenroth, Duesseldorf (DE); Noelle Wrubbel, Duesseldorf (DE)

(73) Assignee: Henkel AG & Co. KGaA, Dusseldorf (DE)

( * ) Notice: Subject to any disclaimer, the term of this patent is extended or adjusted under 35 U.S.C. 154(b) by 44 days.

(21) Appl. No.: 15/520,124

(22) PCT Filed: Oct. 21, 2015

(86) PCT No.: PCT/EP2015/074415
§ 371 (c)(1),
(2) Date: Apr. 19, 2017

(87) PCT Pub. No.: WO2016/062784
PCT Pub. Date: Apr. 28, 2016

(65) Prior Publication Data

US 2017/0321164 A1 Nov. 9, 2017

(30) Foreign Application Priority Data

Oct. 23, 2014 (DE) ..... 10 2014 221 581

(51) Int. Cl.

| | |
|---|---|
| ***C11D 3/39*** | (2006.01) |
| ***C11D 3/16*** | (2006.01) |
| ***C11D 11/00*** | (2006.01) |
| ***C11D 17/00*** | (2006.01) |
| ***C11D 17/04*** | (2006.01) |
| ***C11D 3/00*** | (2006.01) |
| ***C11D 3/20*** | (2006.01) |
| ***C11D 3/28*** | (2006.01) |

(52) U.S. Cl.
CPC ..... *C11D 3/3907* (2013.01); *C11D 3/0073* (2013.01); *C11D 3/168* (2013.01); *C11D 3/2068* (2013.01); *C11D 3/28* (2013.01); *C11D 3/3935* (2013.01); *C11D 11/0023* (2013.01); *C11D 17/0039* (2013.01); *C11D 17/0091* (2013.01); *C11D 17/043* (2013.01)

(58) Field of Classification Search
CPC ..... C11D 11/0023; C11D 17/0039; C11D 17/0091; C11D 17/043; C11D 3/0073; C11D 3/168; C11D 3/2068; C11D 3/28; C11D 3/3907; C11D 3/3935
See application file for complete search history.

(56) References Cited

U.S. PATENT DOCUMENTS

| | | | | |
|---|---|---|---|---|
| 7,205,267 | B2 | 4/2007 | Reinhardt et al. | |
| 2002/0013247 | A1* | 1/2002 | Hage | C11D 3/168 510/302 |
| 2002/0198127 | A1* | 12/2002 | Adriaanse | C11D 3/168 510/305 |
| 2003/0119698 | A1* | 6/2003 | Busch | C11D 3/168 510/302 |
| 2005/0209120 | A1* | 9/2005 | Reinhardt | C11D 3/168 510/312 |
| 2014/0005091 | A1* | 1/2014 | Reinhardt | C11D 3/3932 510/116 |

OTHER PUBLICATIONS

EPO, International Search Report and Written Opinion issued in International Application No. PCT/EP2015/074415, dated Jan. 1, 2016.

* cited by examiner

*Primary Examiner* — Mark Kopec
*Assistant Examiner* — Jaison P Thomas
(74) *Attorney, Agent, or Firm* — Lorenz & Kopf, LLP

(57) ABSTRACT

The present disclosure relates to an automatic dishwasher detergent which comprises metal complex of formula $M^{n+}L(A^{m-})_{n/m}$, wherein M is a metal cation, A is an arbitrary anion, n and m are integers selected from 1 to 6, and L is a neutral ligand of formula (II), wherein each X is as defined herein, and which exhibits improved cleaning performance in the removal of burnt-on soiling, to the use of this dishwasher detergent, and to a method for automatically washing dishes using this dishwasher detergent.

15 Claims, No Drawings

DISHWASHER DETERGENT CONTAINING METAL COMPLEXES

CROSS-REFERENCE TO RELATED APPLICATION

This application is a U.S. National-Stage entry under 35 U.S.C. § 371 based on International Application No. PCT/EP2015/074415, filed Oct. 21, 2015, which was published under PCT Article 21(2) and which claims priority to German Application No. 10 2014 221 581.1, filed Oct. 23, 2014, which are all hereby incorporated in their entirety by reference.

TECHNICAL FIELD

The present disclosure relates to an automatic dishwasher detergent exhibiting improved cleaning performance in the removal of burnt-on soiling, to the use of this dishwasher detergent, and to a method for automatically washing dishes using this dishwasher detergent.

BACKGROUND

The most important criterion when washing dishes automatically is the cleaning performance with respect to a wide variety of soiling types which are introduced into the dishwasher in the form of food residue. Especially in the case of stubborn soiling, such as that arising during the preparation of protein-containing and starchy foods at high temperatures (roasting, baking, frying, gratinating and the like), referred to as burnt-on soiling, the cleaning performance of available dishwasher detergents is still not satisfactory. Such unsatisfactory cleaning performance leads to a lack of satisfaction on the part of the consumer. A general need therefore exists for automatic dishwasher detergents that exhibit good cleaning performance even on burnt-on soiling.

BRIEF SUMMARY

Dishwasher detergents exhibiting improved cleaning performance in the removal of burnt-on soiling, the use of this dishwasher detergent, and methods for automatically washing dishes using this dishwasher detergent are provided herein. In an embodiment, a dishwasher detergent includes, based on the total weight of the dishwasher detergent, about 0.001 to about 10.0 wt. % of at least one metal complex of formula (I)

$$M^{n+}L(A^{m-})_{n/m} \quad (I)$$

wherein

M is a metal cation, selected from Groups 2 to 15 of the periodic table of the elements;

A is an arbitrary anion;

n and m are integers selected from 1 to 6; and

L is a neutral ligand of formula (II)

(II)

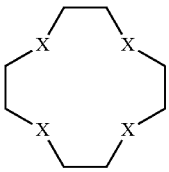

wherein each X is independently O or NR; and each R is independently selected from H, unsubstituted or substituted, linear or branched $C_{1-20}$ alkyl, unsubstituted or substituted, linear or branched $C_{1-20}$ heteroalkyl, unsubstituted or substituted, linear or branched $C_{2-20}$ alkenyl, unsubstituted or substituted, linear or branched $C_{2-20}$ heteroalkenyl, and unsubstituted or substituted, linear or branched $C_{2-20}$ alkinyl.

In another embodiment, a dishwasher detergent includes, based on the total weight of the dishwasher detergent, about 0.001 to about 10.0 wt. % of at least one metal complex of formula (I)

$$M^{n+}L(A^{m-})_{n/m} \quad (I)$$

wherein

M is a metal cation, selected from Groups 2 to 15 of the periodic table of the elements;

A is an arbitrary anion;

n and m are integers selected from 1 to 5; and

L is a neutral ligand of formula (II)

(II)

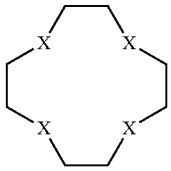

wherein each X is independently O or NR; and each R is independently selected from H, $—(CH_2)_o—CH_3$, wherein o is an integer selected from 3 to 13, $—(CH_2)_p—COOH$ and $—(CH_2)_p—OH$, wherein p is a respective integer selected from 1 to 6.

In another embodiment, use of a metal complex of formula (I) of an automatic dishwasher detergent is provided. The metal complex of formula (I) includes:

$$M^{n+}L(A^{m-})_{n/m} \quad (I)$$

wherein

M is a metal cation, selected from Groups 2 to 15 of the periodic table of the elements;

A is an arbitrary anion;

n and m are integers selected from 1 to 6; and

L is a neutral ligand of formula (II)

(II)

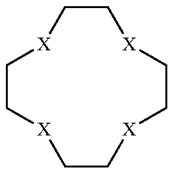

wherein each X is independently O or NR; and each R is independently selected from H, unsubstituted or substituted, linear or branched $C_{1-20}$ alkyl, unsubstituted or substituted, linear or branched $C_{1-20}$ heteroalkyl, unsubstituted or substituted, linear or branched $C_{2-20}$ alkenyl, unsubstituted or substituted, linear or branched $C_{2-20}$ heteroalkenyl, and unsubstituted or substituted, linear or branched $C_{2-20}$ alkinyl.

In another embodiment, use of a metal complex of formula (I) of an automatic dishwasher detergent is provided. The metal complex of formula (I) includes:

$$M^{n+}L(A^{m-})_{n/m} \quad (I)$$

wherein

M is a metal cation, selected from Groups 2 to 15 of the periodic table of the elements;

A is an arbitrary anion;

n and m are integers selected from 1 to 5; and

L is a neutral ligand of formula (II), (II)

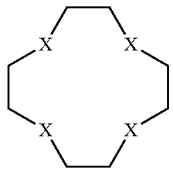

wherein each X is independently O or NR; and each R is independently selected from H, —$(CH_2)_o$—$CH_3$, wherein o is an integer selected from 3 to 13, —$(CH_2)_p$—COOH and —$(CH_2)_p$—OH, wherein p is a respective integer selected from 1 to 6.

DETAILED DESCRIPTION

The following detailed description is merely exemplary in nature and is not intended to limit the disclosure or the application and uses of the subject matter as described herein. Furthermore, there is no intention to be bound by any theory presented in the preceding background or the following detailed description.

Surprisingly, it has now been found that the metal complexes used according to the present disclosure bring about improved cleaning performance with respect to burnt-on soiling when used in common dishwasher detergent formulations.

A first aspect of the present disclosure thus relates to a dishwasher detergent, and in particular to an automatic dishwasher detergent, comprising, based on the total weight of the dishwasher detergent, about 0.001 to about 10.0 wt. %, and in particular about 0.01 to about 1.0 wt. %, of at least one metal complex of formula (I), $$M^{n+}L(A^{m-})_{n/m} \quad (I)$$

wherein

M is a metal cation, selected from Groups 2 to 15 of the periodic table of the elements;

A is an arbitrary anion;

n and m are integers selected from 1 to 6; and

L is a neutral ligand of formula (II)

(II)

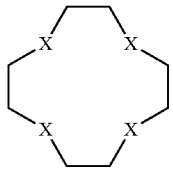

wherein each X is independently O or NR; and each R is independently selected from H, unsubstituted or substituted, linear or branched $C_{1-20}$ alkyl, unsubstituted or substituted, linear or branched $C_{1-20}$ heteroalkyl, unsubstituted or substituted, linear or branched $C_{2-20}$ alkenyl, unsubstituted or substituted, linear or branched $C_{2-20}$ heteroalkenyl, and unsubstituted or substituted, linear or branched $C_{2-20}$ alkinyl.

In a preferred embodiment, each R is independently selected from H, —$(CH_2)_o$—$CH_3$, wherein o is an integer selected from 3 to 13, —$(CH_2)_p$—COOH and —$(CH_2)_p$—OH, wherein p is a respective integer selected from 1 to 6.

The present disclosure also relates to the use of a dishwasher detergent in an automatic dishwashing method, and in particular to the use for improving the cleaning performance in an automatic dishwasher.

The present disclosure furthermore relates to an automatic dishwashing method in which a dishwasher detergent is used in particular for the purpose of improving the cleaning performance.

Finally, the present disclosure relates to the use of the metal complexes used for improving the cleaning performance of an automatic dishwasher detergent.

These and further aspects, features and advantages of the present disclosure become apparent to a person skilled in the art when studying the following detailed description and claims. Every feature from one aspect of the present disclosure may be used in another aspect as contemplated herein. Moreover, it goes without saying that the examples contained herein are intended to describe and illustrate the present disclosure, but do not limit the same, and in particular the present disclosure is not limited to these examples. All percentage information is percent by weight, unless indicated otherwise. Numerical ranges indicated in the format "from x to y" include the mentioned values. If several preferred numerical ranges are indicated in this format, it goes without saying that all ranges resulting from the combination of the different end points are likewise covered.

"At least one," as used herein, denotes 1 or more, which is to say 1, 2, 3, 4, 5, 6, 7, 8, 9, or more. With respect to an ingredient, the expression refers to the type of the ingredient and not to the absolute number of the molecules. "At least one metal complex" thus, for example, denotes at least one type of metal complex, which is to say that one type of metal complex or a mixture of several different metal complexes may be referred to Together with weight information, the expression refers to all compounds of the described type that are present in the composition/mixture, which is to say that, beyond the indicated amounts of the corresponding compounds, the composition does not include any further compounds of this type.

All percentages provided in connection with the compositions described herein refer to wt. %, in each case based on the mixture in question, unless explicitly indicated otherwise.

Within the scope of the present disclosure, unless indicated otherwise, fatty acids or fatty alcohols or the derivatives thereof are representative of branched or unbranched carboxylic acids or alcohols or the derivatives thereof comprising preferably 6 to 22 carbon atoms. In particular, it is also possible to correspondingly use the oxo alcohols or the derivatives thereof obtainable according to Roelen's oxo synthesis, for example.

Whenever alkaline earth metals are mentioned hereafter as counterions for monovalent anions, this shall also mean that the alkaline earth metal, of course, is present only in half the substance amount, sufficient for charge equalization, as the anion.

The metal complexes used in the agents as contemplated herein are those of formula (I).

$$M^{n+}L(A^{m-})_{n/m} \quad (I)$$

In these metal complex, M is a metal cation selected from the metals of Groups 2 to 15 of the periodic table of the elements (CAS groups IIA, IIIA, IVA, VA, IIIB, IVB, VB, VIB, VIIB, VIIIB, IB, IIB or main groups 2 to 5 and transition metals). In various embodiments, M is thus selected from Mg, AI, Ca, Sc, Ti, V, Cr, Mn, Fe, Co, Ni, Cu, Zn, Ga, Sr, Y, Zr, Nb, Mo, Ru, Rh, Pd, Ag, In, Sn, Ba, Hf, Ta, W, Re, Os, Ir, Pt, Au, Hg, Tl, Pb, Bi. In further embodiments, the metal is selected from divalent and trivalent metal cations, and in particular those mentioned above. In still further embodiments, the metal is selected from Cu, Zn, Co, Cr, Ni, Fe, Ru, Rh, Mn, Bi, in particular from Cu, Zn, Co, Ni, Fe, Mn and Bi, more preferably Cu2+, Zn2+, Fe2+, Fe3+, Co2+, Co3+, Mn2+, Mn3+ and Bi3+, still more preferably Cu2+, Zn2+ or Bi3+, most preferably Cu2+ or Zn2+, and in particular Zn2+.

n denotes the valence of the metal cation and is an integer from 1 to 6, preferably from 1 to 5, and especially 2 or 3.

A is an arbitrary anion, in particular selected from the group consisting of inorganic anions such as F−, Cr−, Br−, I−, OH−, HSO3−, SO32−, SO42−, HSO4−, NO2−, NO3−, PO43−, HPO42−, H2PO4−, BF4−, PF6− and ClO4−, or organic anions such as acetate, citrate, formate, glutarate, lactate, malate, malonate, oxalate, pyruvate, tartrate, methanesulfonate (mesilate), methyl sulfate, tosylate, and succinate.

L is a neutral ligand of formula (II)

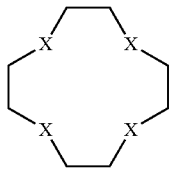

(II)

wherein

X is O or NR.

In different embodiments, all X are O or all X are NR.

Each R is independently selected from H, unsubstituted or substituted, linear or branched C1-20 alkyl, preferably linear C8-18 alkyl, unsubstituted or substituted, linear or branched C1-20 heteroalkyl, in particular an alkyl functional group that is substituted with a (poly)oxyalkylene functional group, unsubstituted or substituted, linear or branched C2-20 alkenyl, unsubstituted or substituted, linear or branched C2-20 heteroalkenyl, and unsubstituted or substituted, linear or branched C2-20 alkinyl.

Preferably, each R is independently selected from H, —(CH2)o-CH3, wherein o is an integer selected from 3 to 13, —(CH2)p-COOH and —(CH2)p-OH, wherein p is a respective integer selected from 1 to 6.

In various embodiments, at least one R is —(CH2)0-CH3, wherein o is an integer selected from 5 to 9, and in particular, for example 7.

In various embodiments, at least one X, and preferably all X are NR. In such embodiments, at least one R is H, and preferably 2 to 3 R are H, and at least one R, and preferably exactly one R, is —(CH2)o-CH3, wherein o is an integer selected from 5 to 9, and in particular o is 7.

In one embodiment, the ligand of formula (II) is an N-substituted cyclen (1,4,7,10-tetraazacyclododecane), in particular N-mono-C4-14-alkyl cyclen, preferably N-mono-C6-10-alkyl cyclen, and still more preferably N-mono-octyl cyclen. In such embodiments, the metal cation is preferably Zn2+, and the anion is preferably SO42−.

In various embodiments, at least one X, and preferably all X are NR. In such embodiments, at least one R is H, and preferably 2 to 3 R are H, and at least one R, and preferably exactly one R, is an alkyl functional group as defined above, such as an octyl, decyl, dodecyl, tetradecyl or hexadecyl functional group. In one embodiment, the ligand of formula (II) is an N-substituted cyclen (1,4,7,10-tetraazacyclododecane), in particular N-mono-alkyl cyclen, preferably N-mono-octyl cyclen, N-mono-decyl cyclen, N-mono-dodecyl cyclen, N-mono-tetradecyl cyclen or N-mono-hexadecyl cyclen. In such embodiments, the metal cation is preferably Cu2+, Zn2+ or Bi3+, particularly preferably Cu2+ or Zn2+, and in particular Zn2+. In such embodiments, the anion can furthermore be a sulfate anion.

The agents as contemplated herein comprise the above-described metal complexes in amounts of about 0.001 to about 10 wt. %, preferably about 0.01 to about 1 wt. %, and still more preferably about 0.1 to about 1 wt. %, based on the total weight of the dishwasher detergent. Absolute amounts are typically in the range of about 0.01 to about 0.2 g/job, and preferably in the range of about 0.05 to about 0.2 g/job.

"Approximately" or "ca.," or "about" as used herein in connection with a numerical value, refers to the numerical value ±10%, and preferably ±5%.

The agents contemplated herein can comprise at least one, and preferably at least two further components, preferably selected from the group consisting of surfactants, in particular non-ionic surfactants and/or anionic surfactants, builders, enzymes, thickeners, sequestering agents, electrolytes, corrosion inhibitors, in particular protection agents, glass corrosion inhibitors, suds suppressors, dyes, fragrances, bittering agents, antimicrobial active ingredients and disintegration auxiliaries.

The agents described herein preferably comprise at least one non-ionic surfactant. All non-ionic surfactants known to a person skilled in the art may be used as non-ionic surfactants.

Suitable non-ionic surfactants are, for example, alkyl glycosides of the general formula RO(G)x, in which R corresponds to a primary straight-chain or methyl-branched, in particular methyl-branched at the 2-position, aliphatic functional group having 8 to 22, and preferably 12 to 18 carbon atoms, and G is the symbol that denotes a glycose unit having 5 or 6 carbon atoms, and preferably glucose. The degree of oligomerization x, which indicates the distribution of monoglycosides and oligoglycosides, is an arbitrary number between 1 and 10; x is preferably about 1.2 to about 1.4.

Non-ionic surfactants of the amine oxide type, for example N-cocoalkyl-N—N-dimethylamine oxide and N-tallowalkyl-N,N-dihydroxyethylamine oxide, and of the fatty acid alkanolamide type may also be suitable. The quantity of these non-ionic surfactants is preferably no more than that of the ethoxylated fatty alcohols, in particular no more than half thereof.

Further suitable surfactants are polyhydroxy fatty acid amides, also known as PHFA.

Preferably, however, low-sudsing non-ionic surfactants are used, in particular alkoxylated, and especially ethoxylated, low-sudsing non-ionic surfactants. It is particularly preferred when the automatic dishwasher detergents comprise non-ionic surfactants from the group of alkoxylated alcohols.

One class of non-ionic surfactants that can be used, which can be used either as the sole non-ionic surfactant or in combination with other non-ionic surfactants, is thus alkoxylated, preferably ethoxylated or ethoxylated and propoxylated fatty acid alkyl esters, preferably comprising 1 to 4 carbon atoms in the alkyl chain.

Surfactants that should preferably be used come from the groups of the ethoxylated primary alcohols and mixtures of these surfactants with structurally more complicated surfactants, such as polyoxypropylene/polyoxyethylene/polyoxypropylene (PO/EO/PO) surfactants. Such (PO/EO/PO) non-ionic surfactants are characterized by good suds control.

Non-ionic surfactants comprising alternating ethylene oxide and alkylene oxide units may be preferred. Among these, in turn, surfactants comprising EO-AO-EO-AO blocks are preferred, wherein in each case one to ten EO or AO groups are bound to one another before a block from the respective other group follows. Here, non-ionic surfactants of the general formula $$R^1—O—(CH_2—CH_2—O)_w—(CH_2—\underset{\underset{R^2}{|}}{CH}—O)_x—(CH_2—CH_2—O)_y—(CH_2—\underset{\underset{R^3}{|}}{CH}—O)_z—H$$

are preferred, in which $R^1$ denotes a straight-chain or branched, saturated, monounsaturated or polyunsaturated $C_{6-24}$ alkyl functional group or alkenyl residue, each group $R^2$ and $R^3$, independently of one another, is selected from $—CH_3$, $—CH_2CH_3$, $—CH_2CH_2—CH_3$, $CH(CH_3)_2$, and the subscripts w, x, y and z, independently of one another, denote integers from 1 to 6.

Thus, in particular, non-ionic surfactants are preferred that comprise a C9-15 alkyl functional group having 1 to 4 ethylene oxide units, followed by 1 to 4 propylene oxide units, followed by 1 to 4 ethylene oxide units, followed by 1 to 4 propylene oxide units.

Preferred non-ionic surfactants are therefore those of the general formula $$R^1—CH(OH)CH_2O\text{-}(AO)_w\text{-}(A'O)_x\text{-}(A''O)_y\text{-}(A'''O)_z—R^2,$$

in which

- $R^1$ denotes a straight-chain or branched, saturated, monounsaturated or polyunsaturated $C_{6-24}$ alkyl functional group or alkenyl residue;
- $R^2$ denotes H or a linear or branched hydrocarbon functional group having 2 to 26 carbon atoms;
- A, A', A" and A'", independently of one another, denote a functional group from the group consisting of $—CH_2CH_2$, $—CH_2CH_2—CH_2$, $—CH_2—CH(CH_3)$, $—CH_2—CH_2—CH_2—CH_2$, $—CH_2—CH(CH_3)—CH_2—$, $—CH_2—CH(CH_2—CH_3)$; and
- w, x, y and z denote values between 0.5 and 120, wherein x, y and/or z may also be 0.

Preferred are in particular end-capped poly(oxyalkylated) non-ionic surfactants that, according to formula R1O[CH2CH2O]xCH2CH(OH)R2, in addition to a functional group R1, which denotes linear or branched, saturated or unsaturated, aliphatic or aromatic hydrocarbon functional groups having 2 to 30 carbon atoms, and preferably having 4 to 22 carbon atoms, also comprise a linear or branched, saturated or unsaturated aliphatic or aromatic hydrocarbon functional group R2 having 1 to 30 carbon atoms, wherein x denotes values between 1 and 90, preferably values between 30 and 80, and in particular values between 30 and 60.

Particularly preferred are surfactants of formula R1O[CH2CH(CH3)O]x[CH2CH2O]yCH2CH(OH)R2, in which R1 denotes a linear or branched, aliphatic hydrocarbon functional group having 4 to 18 carbon atoms or mixtures thereof, R2 denotes a linear or branched hydrocarbon functional group having 2 to 26 carbon atoms or mixtures thereof, x denotes values between 0.5 and 1.5, and y denotes a value of at least 15.

The group of these non-ionic surfactants includes, for example, the C2-26 fatty alcohol-(PO)1-(EO)15-40-2-hydroxyalkyl ethers, and in particular also the C8-10 fatty alcohol-(PO)1-(EO)22-2-hydroxydecyl ethers. Particularly preferred are furthermore those end-capped poly(oxyalkylated) non-ionic surfactants of formula R1O[CH2CH2O]x[CH2CH(R3)O]yCH2CH(OH)R2, in which R1 and R2, independently of one another, denote a linear or branched, saturated, monounsaturated or polyunsaturated hydrocarbon functional group having 2 to 26 carbon atoms, R3, independently of one another, is selected from —CH3, —CH2CH3, —CH2CH2-CH3, —CH(CH3)2, preferably however is —CH3, and x and y, independently of one another, denote values between 1 and 32, wherein non-ionic surfactants where R3=—CH3 and values for x are from 15 to 32 and for y from 0.5 to 1.5 are especially particularly preferred.

Further non-ionic surfactants that may preferably be used are the end-capped poly(oxyalkylated) non-ionic surfactants of formula R1O[CH2CH(R3)O]x[CH2]kCH(OH)[CH2]jOR2, in which R1 and R2 denote linear or branched, saturated or unsaturated, aliphatic or aromatic hydrocarbon functional groups having 1 to 30 carbon atoms, R3 denotes H or a methyl, ethyl, n-propyl, iso-propyl, n-butyl, 2-butyl or 2-methyl-2-butyl functional group, x denotes values between 1 and 30, and k and j denote values between 1 and 12, and preferably between 1 and 5. When the value x≥2, each R3 in the above formula R1O[CH2CH(R3)O]x[CH2]kCH(OH)[CH2]jOR2 may be different. R1 and R2 are preferably linear or branched, saturated or unsaturated, aliphatic or aromatic hydrocarbon functional groups having 6 to 22 carbon atoms, wherein functional groups having 8 to 18 carbon atoms are particularly preferred. H, CH3 or —CH2CH3 are particularly preferred for the functional group R3. Particularly preferred values for x are in the range of 1 to 20, and in particular of 6 to 15.

As described above, each R3 in the above formula may be different when x≥2. In this way, the alkylene oxide unit in the square brackets may be varied. For example, when x is 3, then the functional group R3 may be selected so as to form ethylene oxide—(R3=H) or propylene oxide—(R3=CH3) units, which may be joined to one another in any arbitrary order, for example (EO)(PO)(EO), (EO)(EO)(PO), (EO)(EO)(EO), (PO)(EO)(PO), (PO)(PO)(EO) and (PO)(PO)(PO). The value 3 for x has been selected by way of example here and may certainly also be larger, wherein the variation range increases with increasing x values and, for example, includes a large number of (EO) groups, combined with a low number of (PO) groups, or vice versa.

Particularly preferred end-capped poly(oxyalkylated) alcohols of the above formula have values of k=1 and j=1, whereby the above formula is simplified to R1O[CH2CH(R3)O]x[CH2CH(OH)[CH2OR2. In the last formula, R1, R2 and R3 are as defined above, and x denotes numbers from 1 to 30, preferably from 1 to 20, and in particular 6 to 18. Particularly preferred are surfactants in which the functional groups R1 and R2 comprise 9 to 14 carbon atoms, R3 denotes H, and x takes on values from 6 to 15.

Finally, non-ionic surfactants that have proven to be particularly effective are those of the general formula $R^1$—$CH(OH)CH_2O$-$(AO)_w$—$R^2$ in which

- $R^1$ denotes a straight-chain or branched, saturated, mono-unsaturated or polyunsaturated $C_{6-24}$ alkyl functional group or alkenyl residue;
- $R^2$ denotes a linear or branched hydrocarbon functional group having 2 to 26 carbon atoms;
- A denotes a functional group from the group consisting of $CH_2CH_2$, $CH_2CH_2CH_2$, $CH_2CH(CH_3)$, and preferably $CH_2CH_2$, and
- w denotes values between 1 and 120, preferably 10 to 80, and in particular 20 to 40.

The group of these non-ionic surfactants includes, for example, the C4-22 fatty alcohol-(EO)10-80-2-hydroxyalkyl ethers, and in particular also the C8-12 fatty alcohol-(EO)22-2-hydroxydecyl ethers and the C4-22 fatty alcohol-(EO)40-80-2-hydroxyalkyl ethers.

In various embodiments contemplated herein, it is also possible to use the corresponding not end-capped hydroxy mixed ethers instead of the above-defined end-capped hydroxy mixed ethers. These can satisfy the above formulas, wherein, however, R2 is hydrogen, and R1, R3, A, A', A", A'", w, x, y and z are as defined above.

The agents described herein, comprising at least one non-ionic surfactant, and preferably a non-ionic surfactant from the group of the hydroxy mixed ethers, in different embodiments comprise the surfactant in an amount of at least about 2 wt. %, and preferably of at least about 5 wt. %, based on the total weight of the agent. The absolute amounts used per application may be in the range of about 0.5 to about 10 g/job, and preferably in the range of about 1 to about 5 g/job, for example.

All anionic surface-active substances are suitable anionic surfactants in the dishwasher detergents. These are characterized by a water-soluble-rendering anionic group, such as a carboxylate, sulfate, sulfonate or phosphate group and a lipophilic alkyl group having approximately 8 to 30 carbon atoms. In addition, glycol or polyglycol ether groups, ester, ether and amide groups and hydroxyl groups can be present in the molecule. Suitable anionic surfactants are preferably present in the form of the sodium, potassium and ammonium salts, and monoalkanol, dialkanol and trialkanol ammonium salts having 2 to 4 carbon atoms in the alkanol group.

Preferred anionic surfactants are alkyl sulfates, alkyl polyglycol ether sulfates and ether carboxylic acids having 10 to 18 carbon atoms in the alkyl group, and up to 12 glycol ether groups in the molecule.

In various embodiments, the dishwasher detergents thus comprise at least one surfactant of formula R4-O-(AO)n-SO3-X+.

In this formula, R4 denotes a linear or branched, substituted or unsubstituted alkyl, aryl or alkyl-aryl functional group, preferably a linear, unsubstituted alkyl functional group, and particularly preferably a fatty alcohol functional group. Preferred functional groups R1 are selected from decyl, undecyl, dodecyl, tridecyl, tetradecyl, pentadecyl, hexadecyl, heptadecyl, octadecyl, nonadecyl and eicosyl functional groups and the mixtures thereof, wherein representatives having an even number of carbon atoms are preferred. Particularly preferred functional groups R1 are derived from C12 to C18 fatty alcohols, for example from coconut fatty alcohol, tallow fatty alcohol, lauryl, myristyl, cetyl or stearyl alcohol, or from C10 to C20 oxo alcohols.

AO denotes an ethylene oxide (EO) or propylene oxide (PO) grouping, preferably an ethylene oxide grouping. The subscript n denotes an integer from 1 to 50, preferably from 1 to 20, and in particular from 2 to 10. It is especially particularly preferred if n denotes the numbers 2, 3, 4, 5, 6, 7, or 8. X denotes a monovalent cation or the nth part of an n-valent cation, alkali metal ions being preferred, and among these Na+ or K+, Na+ being extremely preferred. Further cations X+ may be selected from NH4+, ½ ZN2+, ½ Ca2+, ½ Mn2+ and the mixtures thereof.

Particularly preferred anionic surfactants are selected from fatty alcohol ether sulfates of formula A-1

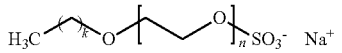

(A-1)

where k=11 to 19, n=2, 3, 4, 5, 6, 7 or 8. Especially particularly preferred representatives are Na—$C_{12-14}$ fatty alcohol ether sulfates comprising 2 EO (k=11 to 13, n=2 in formula A-1).

In addition or as an alternative, the agents can furthermore comprise at least one surfactant of formula R5-A-SO3-Y+.

In this formula, R5 denotes a linear or branched, substituted or unsubstituted alkyl, aryl or alkyl-aryl functional group, and the grouping -A- denotes —O— or a chemical bond. In other words, the above-described formula can be used to describe sulfate—(A=O) or sulfonate—(A= chemical bond) surfactants. Depending on the selection of the grouping A, certain functional groups $R^5$ are preferred. In the sulfate surfactants (A=O), $R^5$ is preferably a linear, unsubstituted alkyl functional group, and particularly preferably a fatty alcohol functional group. Preferred functional groups $R^5$ are selected from decyl, undecyl, dodecyl, tridecyl, tetradecyl, pentadecyl, hexadecyl, heptadecyl, octadecyl, nonadecyl and eicosyl functional groups and the mixtures thereof, wherein representatives having an even number of carbon atoms are preferred. Particularly preferred functional groups $R^5$ are derived from $C_{12}$ to $C_{18}$ fatty alcohols, for example from coconut fatty alcohol, tallow fatty alcohol, lauryl, myristyl, cetyl or stearyl alcohol, or from $C_{10}$ to $C_{20}$ oxo alcohols. Y denotes a monovalent cation or the nth part of an n-valent cation, alkali metal ions being preferred, and among these $Na^+$ or $K^+$, $Na^+$ being extremely preferred. Further cations Y+ can be selected from $NH_4^+$, ½ $Zn^{2+}$, ½ $Mg^{2+}$, ½ $Ca^{2+}$, ½ $Mn^{2+}$, and the mixtures thereof.

Such particularly preferred surfactants are selected from fatty alcohol sulfates of formula

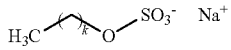

where k=11 to 19. Especially particularly preferred representatives are Na—$C_{12-14}$ fatty alcohol sulfates (k=11 to 13).

In the sulfonate surfactants (A=chemical bond), R5 is preferably a linear or branched unsubstituted alkyl-aryl functional group. Again, X denotes a monovalent cation or the nth part of an n-valent cation, alkali metal ions being preferred, and among these Na+ or K+, Na+ being extremely preferred. Further cations X+ can be selected from NH4+, ½ Zn2+, ½ Mg2+, ½ Ca2+, ½ Mn2+, and the mixtures thereof. Such surfactants may be selected from linear or branched alkylbenzene sulfonates.

Cationic and/or amphoteric surfactants, such as betaines or quaternary ammonium compounds, can also be used instead of or in conjunction with the described surfactants. However, it is preferred that no cationic and/or amphoteric surfactants are used.

Builders that may be present dishwasher detergent are in particular silicates, aluminum silicates (in particular zeolites), carbonates, organic dicarboxylic and polycarboxylic acids, and aminocarboxylic acids and the salts thereof, and, where ecological bias against their use is absent, also phosphates. Naturally, mixtures of these substances may also be used.

For example, it is possible to use crystalline phyllosilicates of the general formula NaMSixO2x+1.y H2O, in which M is sodium or hydrogen, x is a number from 1.9 to 22, and preferably from 1.9 to 4, wherein particularly preferred values for x are 2, 3 or 4, and y is a number from 0 to 33, and preferably from 0 to 20. The crystalline phyllosilicates of formula NaMSixO2x+1.y H2O are sold under the trade name Na-SKS by Clariant GmbH (Germany), for example. Examples of these silicates are Na-SKS-1 (Na2Si22O45.x H2O, kenyaite), Na-SKS-2 (Na2Si14O29.x H2O, magadiite), Na-SKS-3 (Na2Si8O17.x H2O) or Na-SKS-4 (Na2Si4O9.x H2O, makatite). For the purposes of the present disclosure, crystalline phyllosilicates of formula NaMSixO2x+1.y H2O in which x denotes 2 are particularly suitable. In particular, both β- and δ-sodium silicates Na2Si2O5.y H2O are preferred, and furthermore especially Na-SKS-5 (α-Na2Si2O5), Na-SKS-7 (β-Na2Si2O5, natrosilite), Na-SKS-9 (NaHSi2O5.H2O), Na-SKS-10 (NaHSi2O5.3 H2O, kanemite), Na-SKS-11 (t-Na2Si2O5) and Na-SKS-13 (NaHSi2O5), in particular however Na-SKS-6 (δ-Na2Si2O5).

Automatic dishwasher detergents typically comprise a percent by weight of the crystalline phyllosilicate of formula NaMSixO2x+1.y H2O of about 0.1 to about 20 wt. %, preferably of about 0.2 to about 15 wt. %, and in particular of about 0.4 to about 10 wt. %, in each case based on the total weight of these agents.

It is also possible to use amorphous sodium silicates having a Na2O:SiO2 module of about 1:2 to about 1:3.3, preferably of about 1:2 to about 1:2.8, and in particular of about 1:2 to about 1:2.6, which preferably exhibit retarded dissolution and secondary washing properties. The retarded dissolution compared to conventional amorphous sodium silicates can have been caused in a variety of ways, for example by way of surface treatment, compounding, compacting/compression or over-drying. Within the scope of the present disclosure, the term "amorphous" shall be understood to mean that the silicates do not supply any sharp X-ray reflexes in X-ray diffraction experiments, such as those that are typical of crystalline substances, but at best evoke one or more maxima of the scattered X-rays, which have a width of several degree units of the diffraction angle.

Within the scope of the present disclosure, it is preferred that this silicate or these silicates, preferably alkali silicates, and particularly preferably crystalline or amorphous alkali disilicates, is or are present in the agents in amounts of about 1 to about 40 wt. %, and preferably of about 2 to about 35 wt. %, in each case based on the weight of the automatic dishwasher detergent.

It is also possible, of course, to use the generally known phosphates as builder substances, provided that such use should not be avoided for ecological reasons. Among the plurality of commercially available phosphates, alkali metal phosphates have the greatest significance in the washing agent or dishwasher detergent industry, pentasodium and pentapotassium triphosphate (sodium or potassium tripolyphosphate) being particularly preferred.

Alkali metal phosphates is the term that covers all the alkali metal (in particular sodium and potassium) salts of the different phosphoric acids, in which a distinction can be made between metaphosphoric acids (HPO3)n and orthophosphoric acid H3PO4, in addition to higher molecular weight representatives. The phosphates combine several advantages: They act as alkali carriers, prevent limescale deposits on machine parts or lime scaling on woven fabrics, and additionally contribute to the cleaning performance.

Technically particularly important phosphates are pentasodium triphosphate, Na5P3O10 (sodium tripolyphosphate), and the corresponding potassium salt pentapotassium triphosphate, K5P3O10 (potassium tripolyphosphate) and corresponding mixed salts (sodium potassium tripolyphosphates). Preferably, however, the agents are phosphate-free.

If within the scope of the present application phosphates are used as substances with cleaning action in the automatic dishwasher detergent, preferred agents comprise this phosphate or these phosphate, preferably alkali metal phosphate(s), particularly preferably pentasodium or pentapotassium triphosphate (sodium or potassium tripolyphosphate), in amounts from about 5 to about 80 wt. %, preferably from about 10 to about 60 wt. %, and in particular from about 18 to about 45 wt. %, in each case based on the weight of the automatic dishwasher detergent.

The dishwasher detergents can in particular also comprise phosphonates as a further builder. The phosphonate compound used is preferably a hydroxyalkane phosphonate and/or aminoalkane phosphonate. Among the hydroxyalkane phosphonates, 1-hydroxy ethane-1,1-diphosphonate (HEDP) is of particular importance. Possible preferred aminoalkane phosphonates include ethylenediaminetetramethylene phosphonate (EDTMP), diethylentriaminepentamethylene phosphonate (DTPMP) and the higher homologs thereof. Phosphonates are preferably present in the agents in amounts of about 0.1 to about 10 wt. %, and in particular in amounts of about 0.5 to about 8 wt. %, in each case based on the total weight of the dishwasher detergent.

Other builders are the alkali carriers. For example, alkali metal hydroxides, alkali metal carbonates, alkali metal hydrogen carbonates, alkali metal sesquicarbonates, the described alkali silicates, alkali metasilicates and mixtures of the above-mentioned substances are considered alkali carriers, wherein within the meaning of the present disclosure preferably the alkali carbonates, in particular sodium carbonate, sodium hydrogen carbonate or sodium sesquicarbonate, can be used. A builder system containing a mixture of tripolyphosphate and sodium carbonate is particularly preferred. A builder system containing a mixture of tripolyphosphate and sodium carbonate and sodium silicate is likewise particularly preferred. Given the low chemical compatibility with the remaining ingredients of automatic dishwasher detergents compared to other builder substances, the optional alkali metal hydroxides are preferably used only in low amounts, preferably in amounts of less than about 10 wt. %, especially less than about 6 wt. %, particularly preferably less than about 4 wt. %, and in particular less than about 2 wt. %, in each case based on the total weight of the automatic dishwasher detergent. Agents that, based on the total weight thereof, comprise less than about 0.5 wt. %, and in particular no alkali metal hydroxides, are particularly preferred.

The use of carbonate(s) and/or hydrogen carbonate(s), preferably alkali carbonate(s), particularly preferably sodium carbonate, in amounts from about 2 to about 50 wt. %, preferably from about 5 to about 40 wt. %, and in particular from about 7.5 to about 30 wt. %, in each case based on the weight of automatic dishwasher detergent, is particularly preferred. Agents that, based on the weight of the automatic dishwashing agent, contain less than about 20 wt. %, especially less than about 17 wt. %, preferably less than about 13 wt. %, and in particular less than about 9 wt. % carbonate(s) and/or hydrogen carbonate(s), preferably alkali carbonate(s), particularly preferably sodium carbonate, are particularly preferred.

In particular, polycarboxylates/polycarboxylic acids, polymeric polycarboxylates, aspartic acid, polyacetals, dextrins, further organic cobuilders and phosphonates, which were already mentioned above as builders, shall be mentioned as organic builders. These substance classes are described hereafter.

Usable organic builder substances are, for example, the polycarboxylic acids that can be used in the form of the free acid and/or of the sodium salts thereof, wherein polycarboxylic acids shall be understood to mean those carboxylic acids that carry more than one acid function. These include, for example, citric acid, adipic acid, succinic acid, glutaric acid, malic acid, tartaric acid, maleic acid, fumaric acid, saccharic acids, nitrilotriacetic acid (NTA), provided that such use is not objectionable for ecological reasons, and mixtures thereof. In addition to the builder effect, the free acids typically also have the property of being an acidifying component and are thus also used to set a lower and milder pH value of the automatic dishwasher detergents. In particular, citric acid, succinic acid, glutaric acid, adipic acid, gluconic acid and arbitrary mixtures of these shall be mentioned here.

The use of citric acid and/or citrates in these agents has proven to be particularly advantageous for the cleaning and rinsing performance of the agents described herein. Automatic dishwasher detergents are thus preferably characterized in that the automatic dishwasher detergent comprises citric acid or a salt of citric acid.

Aminocarboxylic acids and/or the salts thereof are another significant class of phosphate-free builders. Particularly preferred representatives of this class are methylglycine diacetic acid (MGDA) or the salts thereof, and glutamine diacetic acid (GLDA) or the salts thereof or ethylenediamine diacetic acid (EDDS) or the salts thereof. The content of these aminocarboxylic acids or of the salts thereof can amount to between about 0.1 and about 30 wt. %, preferably between about 1 and about 25 wt. %, and in particular between about 5 and about 20 wt. %, for example. Aminocarboxylic acids and the salts thereof can be used together with the above-mentioned builders, in particular also with the phosphate-free builders.

The dishwasher detergents according to the disclosure can furthermore comprise a sulfo polymer. The percent by weight of the sulfo polymer in the total weight of the dishwasher detergent as contemplated herein is preferably about 0.1 to about 20 wt. %, in particular about 0.5 to about 18 wt. %, particularly preferably about 1.0 to about 15 wt. %, in particular about 4 to about 14 wt. %, and especially about 6 to about 12 wt. %. The sulfo polymer is typically used in the form of an aqueous solution, wherein the aqueous solutions typically comprise about 20 to about 70 wt. %, in particular about 30 to about 50 wt. %, and preferably approximately about 35 to about 40 wt. % sulfo polymers.

Preferably, the sulfo polymer used is a copolymeric polysulfonate, and preferably a hydrophobically modified copolymeric polysulfonate.

The copolymers can comprise two, three, four or more different monomer units. Preferred copolymeric polysulfonates comprise at least one monomer from the group of the unsaturated carboxylic acids, in addition to sulfonic group-containing monomer(s).

Particularly preferably, unsaturated carboxylic acids of formula R1(R2)C═C(R3)COOH are used as unsaturated carboxylic acid(s), in which R1 to R3, independently of one another, denote —H, —CH3, a straight-chain or branched saturated alkyl functional group having 2 to 12 carbon atoms, a straight-chain or branched, monounsaturated or polyunsaturated alkenyl residue having 2 to 12 carbon atoms, alkyl functional groups or alkenyl residues substituted with —NH2, —OH or —COOH as defined above, or —COOH or —COOR4, wherein R4 is a saturated or unsaturated, straight-chain or branched hydrocarbon functional group having 1 to 12 carbon atoms.

Particularly preferred unsaturated carboxylic acids are acrylic acid, methacrylic acid, ethacrylic acid, α-chloroacrylic acid, α-cyanoacrylic acid, crotonic acid, α-phenylacrylic acid, maleic acid, maleic anhydride, fumaric acid, itaconic acid, citraconic acid, methylene malonic acid, sorbic acid, cinnamic acid or the mixtures thereof. It is also possible, of course, to use the unsaturated dicarboxylic acids.

Among the sulfonic acid group-containing monomers, those of formula

R5(R6)C═C(R7)-X—SO3H are preferred, in which R5 to R7, independently of one another, denote —H, —CH3, a straight-chain or branched saturated alkyl functional group having 2 to 12 carbon atoms, a straight-chain or branched, monounsaturated or polyunsaturated alkenyl residue having 2 to 12 carbon atoms, alkyl functional groups or alkenyl residues substituted with —NH2, OH or —COOH, or —COOH or COOR4, wherein R4 is a saturated or unsaturated, straight-chain or branched hydrocarbon functional group having 1 to 12 carbon atoms, and X denotes an optionally present spacer group which is selected from —(CH2)n- where n=0 to 4, —COO—(CH2)k- where k=1 to 6, —C(O)—NH—C(CH3)2-, —C(O)—NH—C(CH3)2-CH2- and —C(O)—NH—CH(CH3)-CH2-.

Preferred among these monomers are those of formulas

H2C═CH—X—SO3H

H2C═C(CH3)-X—SO3H

HO3S—X—(R6)C═C(R7)-X—SO3H, in which R6 and R7, independently of one another, are selected from —H, —CH3, —CH2CH3, —CH2CH2CH3 and —CH(CH3)2, and X denotes an optionally present spacer group, which is selected from —(CH2)n- where n=0 to 4, —COO—(CH2)k- where k=1 to 6, —C(O)—NH—C(CH3)2-, —C(O)—NH—C(CH3)2-CH2- and —C(O)—NH—CH(CH3)-CH2-.

Particularly preferred sulfonic acid group-containing monomers are 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxypropanesulfonic acid, allylsulfonic acid, methallylsulfonic acid, allyloxybenzesulfonic acid, methallyloxybenzenesulfonic acid, 2-hydroxy-3-(2-propenyloxy)propanesulfonic acid, 2-methyl-2-propenesulfonic acid, styrenesulfonic acid, vinylsulfonic acid, 3-sulfopropylacrylate, 3-sulfopropylmethacrylate, sulfomethacrylamide, sulfomethylmethacrylamide, and mixtures of the described acids or the water-soluble salts thereof.

The sulfonic acid groups can be present entirely or partially in neutralized form in the polymer, which is to say that, in some or all sulfonic acid groups, the acid hydrogen atom of the sulfonic acid group can be replaced with metal ions, preferably alkali metal ions, and in particular with sodium ions. The use of partially or fully neutralized sulfonic acid group-containing copolymers is preferred according to the disclosure.

The monomer distribution of the preferably used copolymers is preferably about 5 to about 95 wt. % for copolymers that comprise only carboxylic acid group-containing monomers and sulfonic acid group-containing monomers, and particularly preferably the content of the sulfonic acid group-containing monomer is about 50 to about 90 wt. % and the content of the carboxylic acid group-containing monomer is about 10 to about 50 wt. %, the monomers preferably being selected from those described above.

The molar mass of the preferably used sulfo copolymers can be varied so as to adapt the properties of the polymers to the desired intended purpose. Preferred dishwasher detergents are characterized in that the copolymers have molar masses of about 2000 to about 200,000 g/mol-1, preferably of about 4000 to about 25,000 g/mol-1, and in particular of about 5000 to about 15000 g/mol-1.

The dishwasher detergents can furthermore comprise further polymers. The group of suitable polymers includes in particular polymers with cleaning action, for example rinse polymers and/or polymers acting as softeners.

Polymers that are preferably used come from the group of alkylacrylamide/acrylic acid copolymers, alkylacrylamide/methacrylic acid copolymers, alkylacrylamide/methylmethacrylic acid copolymers, alkylacrylamide/acrylic acid/alkylaminoalkyl(meth)acrylic acid copolymers, alkylacrylamide/methacrylic acid/alkylaminoalkyl(meth)acrylic acid copolymers, alkylacrylamide/methylmethacrylic acid/alkylaminoalkyl(meth)acrylic acid copolymers, alkylacrylamide/alkyl methacrylate/alkylaminoethyl methacrylate/alkyl methacrylate copolymers, and copolymers of unsaturated carboxylic acids, cationically derivatized unsaturated carboxylic acids, and optionally further ionic or non-ionogenic monomers.

Further polymers that may be used come from the group of acrylamidoalkyltrialkylammonium chloride/acrylic acid copolymers and the alkali and ammonium salts thereof, acrylamidoalkyltrialkylammonium chloride/methacrylic acid copolymers and the alkali and ammonium salts thereof, and methacroylethylbetaine/methacrylate copolymers.

Cationic polymers that may be used come from the groups of quaternized cellulose derivatives, polysiloxanes comprising quaternary groups, cationic guar derivatives, polymeric dimethyldiallylammonium salts and the copolymers thereof with acrylic acid and methacrylic acid and the esters and amides of acrylic acid and methacrylic acid, copolymers of vinylpyrrolidone with quaternized derivatives of dialkylaminoacrylate and -methacrylate, vinylpyrrolidone/methoimidazolinium chloride copolymers, quaternized polyvinyl alcohols, or the polymers described by the INCI names Polyquaternium 2, Polyquaternium 17, Polyquaternium 18, and Polyquaternium 27.

The amounts mentioned above for the described surfactants and builders usually refer to the amounts used when the respective surfactant or the respective builder is used alone, unless indicated otherwise. It therefore goes without saying that the amounts must be accordingly adapted when multiple surfactants or builders are used.

The agents as contemplated herein preferably contain at least one enzyme preparation or enzyme composition, which contains one or more enzymes. Suitable enzymes include, but are not limited to, proteases, amylases, lipases, hemicellulases, cellulases, perhydrolases or oxidoreductases, and preferably the mixtures thereof. These enzymes are, in principle, of natural origin; proceeding from the natural molecules, improved variants are available for use in dishwasher detergents and are used in correspondingly preferred fashion. The agents preferably comprise enzymes in total amounts of about 1×10-6 to about 5 wt. %, based on active protein. The protein concentration can be determined using known methods, such as the BCA method or the biuret method.

Proteases are some of the technically most significant enzymes. They cause protein-containing soiling on the goods to be cleaned to decompose. Among these, in turn, proteases of the subtilisin type (subtilases, subtilopeptidases, EC 3.4.21.62) are particularly important, which due to the catalytically active amino acids are serine proteases. They act as non-specific endopeptidases and hydrolyze arbitrary acid amide bonds that lie in the interior of peptides or proteins. The pH optimum of these is usually in the distinctly alkaline range. Subtilases are formed naturally from microorganisms. Among these, in particular the subtilisins formed and secreted by the *Bacillus* species shall be mentioned as the most significant group within the subtilases.

Examples of the proteases of the subtilisin type preferably used in washing agents and dishwasher detergents are the subtilisins BPN' and Carlsberg, the protease PB92, the subtilisins 147 and 309, the protease from *Bacillus lentus*, and in particular from *Bacillus lentus* DSM 5483, subtilisin DY, and the thermitase enzymes, which can be assigned to the subtilases, but not to the subtilisins in the narrower sense, proteinase K, and the proteases TW3 and TW7, and variants of the described proteases which have a modified amino acid sequence compared to the starting protease. Proteases are modified deliberately or randomly using methods known from the prior art and thus optimized for the use in washing agents and dishwasher detergents, for example. These include point mutagenesis, deletion or insertion mutagenesis or fusion with other proteins or protein fragments. Appropriately optimized variants are known for the majority of proteases known from the prior art.

Examples of amylases that may be used include the α-amylases from *Bacillus licheniformis*, from *B. amyloliquefaciens* and from *B. stearothermophilus*, from *Aspergillus niger* and *A. oryzae*, and the refinements of the aforementioned amylases improved for the use in dishwasher detergents. For this purpose, furthermore the α-amylase from *Bacillus* sp. A 7-7 (DSM 12368) and the cyclodextrin glucanotransferase (CGTase) from *B. agaradherens* (DSM 9948) shall be emphasized.

Furthermore, lipases or cutinases may be used, in particular for the triglyceride-liberating activities thereof, but also so as to create peroxy acids in situ from suitable precursors. These include, for example, the lipases which were originally obtainable or further developed from *Humi-*

*cola lanuginosa* (*Thermomyces lanuginosus*), in particular those including the D96L amino acid substitution.

Furthermore, enzymes that are combined under the term hemicellulases may be used. These include, for example, mannanases, xanthan lyases, pectin lyases (=pectinases), pectin esterases, pectate lyases, xyloglucanases (=xylanases), pullulanases and β-glucanases To enhance the bleaching action, oxidoreductases, for example oxidases, oxygenases, catalases, peroxidases, such as haloperoxidases, chloroperoxidases, bromoperoxidases, lignin peroxidases, glucose peroxidases or manganese peroxidases, dioxygenases or laccases (phenol oxidases, polyphenol oxidases) may be used. Advantageously, preferably organic, and particularly preferably aromatic, compounds that interact with the enzymes are additionally added so as to enhance the activity of the particular oxidoreductases (enhancers), or so as to ensure the electron flux in the event of large differences in the redox potentials of the oxidizing enzymes and the soilings (mediators).

In particular, during storage, an enzyme can be protected against damage, such as inactivation, denaturing or disintegration, for example due to physical influences, oxidation or proteolytic cleavage. Inhibiting proteolysis is particularly preferred in the case of microbial production of the proteins and/or enzymes, in particular when the agents comprise proteases. Dishwasher detergents may comprise stabilizers for this purpose; the provision of such agents constitutes a preferred embodiment of the present disclosure.

Proteases and amylases with cleaning action are generally not provided in form of the pure protein, but rather in the form of stabilized, storable and transportable preparations. These preformulated preparations include, for example, solid preparations obtained by way of granulation, extrusion or lyophilization or, in particular in the case of liquid or gel-like agents, solutions of the enzymes, advantageously concentrated to the extent possible, low-hydrate and/or mixed with stabilizers or other auxiliary agents.

Alternatively, the enzymes can be encapsulated, both for the solid and the liquid packaging format, for example by spray drying or extruding the enzyme solution together with a preferably natural polymer, or in the form of capsules, for example those in which the enzymes are enclosed as in a solidified gel, or in those of the core-shell type, in which an enzyme-containing core is coated with a protective layer impervious to water, air and/or chemicals. Further active ingredients, such as stabilizers, emulsifiers, pigments, bleaching agents or dyes can additionally be applied in superimposed layers. Such capsules are applied using methods that are known per se, for example agitation or roll granulation or in fluid bed processes. Such granules are advantageously low-dust, for example by applying polymeric film formers, and storage-stable due to the coating.

It is furthermore possible to formulate two or more enzymes together, so that individual granules have multiple enzyme activities.

As is apparent from the comments above, the enzyme protein forms only a fraction of the total weight of customary enzyme preparations. Preferably used protease and amylase preparations contain between about 0.1 and about 40 wt. %, preferably between about 0.2 and about 30 wt. %, particularly preferably between about 0.4 and about 20 wt. %, and in particular between about 0.8 and about 10 wt. % of the enzyme protein. In particular, dishwasher detergents that, based on the total weight thereof, comprise about 0.1 to about 12 wt. %, preferably about 0.2 to about 10 wt. %, and in particular about 0.5 to about 8 wt. % enzyme preparations are preferred.

The compositions described herein can also comprise enzyme stabilizers. One group of stabilizers is that of reversible protease inhibitors. Frequently, benzamidine hydrochloride, borax, boric acids, boronic acids or the salts or esters thereof are used for this purpose, including especially derivatives with aromatic groups, such as ortho-, meta- or para-substituted phenylboronic acids, in particular 4-formylphenylboronic acid, or the salts or esters of the compounds mentioned. Peptide aldehydes, which is to say oligopeptides having a reduced C terminus, and in particular those formed from about 2 to about 50 monomers, are used for this purpose. The peptidic reversible protease inhibitors include ovomucoid and leupeptin. Specific reversible peptide inhibitors for the protease subtilisin and fusion proteins formed from proteases and specific peptide inhibitors are also suitable for this purpose.

Further enzyme stabilizers are amino alcohols such as mono-, di-, triethanol- and propanolamine and the mixtures thereof, aliphatic carboxylic acids up to C12, such as succinic acid, other dicarboxylic acids or salts of the acids mentioned. End-capped fatty acid amide alkoxylates are also suitable for this purpose. Other enzyme stabilizers are known to a person skilled in the art from the prior art.

Bleaching agents are substances with cleaning action. Among the compounds that serve as bleaching agents and yield H2O2 in water, sodium percarbonate, sodium perborate tetrahydrate, and sodium perborate monohydrate are of particular importance. Further usable bleaching agents are, for example, peroxypyrophosphates, citrate perhydrates, and peracid salts or peracids that yield H2O2, such as perbenzoates, peroxophthalates, diperazelaic acid, phthaloimino peracid, or diperdodecanedioic acid. All further inorganic or organic peroxy bleaching agents known from the prior art to a person skilled in the art may also be used. Percarbonates, and here in particular sodium percarbonate, are particularly preferred bleaching agents.

In various embodiments, the dishwasher detergents can comprise about 1 to about 35 wt. %, preferably about 2.5 to about 30 wt. %, particularly preferably about 3.5 to about 20 wt. %, and in particular about 5 to about 15 wt. % bleaching agent, preferably sodium percarbonate.

In various embodiments, the automatic dishwasher detergents additionally comprise at least one bleach activator. Compounds that, under perhydrolysis conditions, yield aliphatic peroxocarboxylic acids having preferably 1 to 10 carbon atoms, in particular 2 to 4 carbon atoms, and/or optionally substituted perbenzoic acid, can be used as bleach activators. Out of all bleach activators known to a person skilled in the art from the prior art, polyacylated alkylenediamines, in particular tetra acetyl ethylene diamine (TAED), acylated triazine derivatives, in particular 1,5-diacetyl-2,4-dioxohexahydro-1,3,5-triazine (DADHT), acylated glycolurils, in particular tetraacetyl glycoluril (TAGU), N-acylimides, in particular N-nonanoyl succinimide (NOSI), acylated phenolsulfonates, in particular n-nonanoyl or iso-nonanoyl oxybenzene sulfonate (n- or iso-NOBS), are particularly preferred. It is also possible to use combinations of conventional bleach activators. TAED, in particular in combination with a percarbonate bleaching agent, preferably sodium percarbonate, is an especially particularly preferred bleach activator.

These bleach activators are preferably used in amounts of up to about 10 wt. %, in particular about 0.1 wt. % to about 8 wt. %, particularly about 2 to about 8 wt. %, and particularly preferably about 2 to about 6 wt. %, in each case based on the total weight of the agent.

In general, the pH value of the dishwasher detergent can be set using customary pH regulators, wherein the pH value is selected depending on the desired usage purpose. In various embodiments, the pH value is in a range of about 5.5 to about 10.5, preferably about 5.5 to about 9.5, still more preferably about 7 to about 9, in particular greater than about 7, and especially in the range of about 7.5 to about 8.5. Acids and/or alkalis, preferably alkalis, are used for pH adjustment. Succinic acids are in particular organic acids, such as acetic acid, citric acid, glycolic acid, lactic acid, succinic acid, adipic acid, malic acid, tartaric acid, and gluconic acid, or amidosulfonic acid. In addition, however, it is also possible to use the mineral acids hydrochloric acid, sulfuric acid and nitric acid, or the mixtures thereof. Suitable bases come from the group of the alkali metal and alkaline earth metal hydroxides and carbonates, in particular the alkali metal hydroxides, among which potassium hydroxide and especially sodium hydroxide are preferred. Volatile alkali, however, is particularly preferred, for example in the form of ammonia and/or alkanolamines, which can contain up to 9 carbon atoms in the molecule. The alkanolamine is preferably selected from the group consisting of mono-, di-, triethanol- and -propanolamine and the mixtures thereof.

So as to set and/or stabilize the pH value, the agent as contemplated herein can also comprise one or more buffer substances (INCI Buffering Agents), usually in amounts of about 0.001 to about 5 wt. %. Buffering agents that simultaneously are complexing agents or even chelating agents (chelators, INCI Chelating Agents) are preferred. Particularly preferred buffering agents are citric acid or the citrates, and in particular sodium and potassium citrates, such as trisodium citrate.2H2O and tripotassium citrate.H2O.

Glass corrosion inhibitors prevent the appearance of clouding, streaking, and scratching, but also iridescence of the glass surface of automatically cleaned glassware. Preferred glass corrosion inhibitors come from the group of magnesium and zinc salts and of the magnesium and zinc complexes. Within the scope of the present disclosure, the content of zinc salt in dishwasher detergents is especially between about 0.1 and about 5 wt. %, preferably between about 0.2 and about 4 wt. %, and in particular between about 0.4 and about 3 wt. %, or the content of zinc in oxidized formed (calculated as Zn2+) is between about 0.01 and about 1 wt. %, especially between about 0.02 and about 0.5 wt. %, and in particular between about 0.04 and about 0.2 wt. %, in each case based on the total weight of the glass corrosion inhibitor-containing agent.

Individual odorous substance compounds, such as synthetic products of the ester, ether, aldehyde, ketone, alcohol, and hydrocarbon types, can be used within the scope of the present disclosure as perfume oils or fragrances. Preferably, however, mixtures of different odorants are used, which together produce an appealing odorous note. Such perfume oils can also contain natural odorous substance mixtures such as those accessible from plant sources, for example pine, citrus, jasmine, patchouli, rose, or ylang ylang oil.

Furthermore, preservatives can be present in the agents. Suitable preservatives are, for example, those from the groups of the alcohols, aldehydes, antimicrobial acids and/or the salts thereof, carboxylic acid esters, acid amides, phenols, phenol derivatives, diphenyls, diphenyl alkanes, urea derivatives, oxygen and nitrogen acetals and formals, benzamidines, isothiazoles and the derivatives thereof, such as isothiazolins and isothiazolinones, phthalimide derivatives, pyridine derivatives, antimicrobial surface-active compounds, guanidines, antimicrobial amphoteric compounds, quinolines, 1,2-dibromo-2,4-dicyanobutane, iodo-2-propynyl butyl carbamate, iodine, iodophores, and peroxides. Preferred antimicrobial active ingredients are preferably selected from the group consisting of ethanol, n-propanol, propanol, 1,3-butanediol, phenoxyethanol, 1,2-propylene glycol, glycerol, undecylenic acid, citric acid, lactic acid, benzoic acid, salicylic acid, thymol, 2-benzyl-4-chlorophenol, 2,2'-methylene-bis-(6-bromo-4-chlorophenol), 2,4,4'-trichloro-2'-hydroxydiphenyl ether, N-(4-chlorophenyl)-N-(3,4-dichlorophenyl) urea, N,N'-(10-decandiyldi-1-pyridinyl-4-ylidene)-bis-(1-octanamine)-dihydrochloride, N,N'-bis-(4-chlorophenyl)-3,12-diimino-2,4,11,13-tetraazatetradecane diimidamide, antimicrobial quaternary surface-active compounds, and guanidines. Particularly preferred preservatives, however, are selected from the group consisting of salicylic acid, quaternary surfactants, and in particular benzalkonium chloride and isothiazoles, and the derivatives thereof, such as isothiazolines and isothiazolinones.

In general, the automatic dishwasher detergents described herein can be formulated in a variety of ways. The agents can be present in solid or liquid presentation forms or as a combination of solid and liquid presentation forms. Suitable solid presentation forms are, in particular, powders, granules, extrudates, compactates, in particular tablets. The liquid presentation forms based on water and/or organic solvents can be present in thickened form, in the form of gels. The agents can be formulated in the form of single-phase or multi-phase products. The individual phases of multiphase agents can have identical or different states of aggregation.

The dishwasher detergent can also be present in the form of shaped bodies. So as to facilitate the breakdown of such prefabricated shaped bodies, it is possible to incorporate disintegration auxiliaries, known as tablet disintegrants, into these agents in order to shorten breakdown times. Tablet disintegrants or disintegration accelerators are understood to mean auxiliaries that ensure a rapid breakdown of tablets in water or other media, and the quick release of the active ingredients. Disintegration auxiliaries can preferably be used in amounts from about 0.5 to about 10 wt. %, preferably about 3 to about 7 wt. %, and in particular about 4 to about 6 wt. %, in each case based on the total weight of the agent comprising the disintegration auxiliary.

The automatic dishwasher detergents described herein are preferably preformulated as dosing units. These dosing units preferably comprise the quantity of substances with cleaning action necessary for one cleaning cycle. Preferred dosing units have a weight between about 12 and about 30 g, preferably between about 14 and about 26 g, and in particular between about 16 and about 22 g. The volume of the aforementioned dosing units and the three-dimensional shape thereof are particularly preferably selected such that dosability of the preformulated units via the dosing chamber of a dishwasher is ensured. The volume of the dosing unit is thus preferably between about 10 and about 35 ml, and especially between about 12 and about 30 mol.

The automatic dishwasher detergents, and in particular the prefabricated dosing units, particularly preferably comprise a water-soluble wrapping.

The water-soluble wrapping is preferably formed of a water-soluble film material selected from the group consisting of polymers or polymer mixtures. The wrapping can be formed of one layer, or of two or more layers of the water-soluble film material. The water-soluble film material of the first layer and that of the further layers, if such are present, can be the same or different. Films that can be bonded and/or sealed, after they have been loaded with the agent, to form packaging such as tubes or cushions, are particularly preferred.

The water-soluble packaging can comprise one or more chambers. The agent can be present in one or more chambers, if present, of the water-soluble wrapping. The amount of the agent preferably corresponds to the full dose, or half the dose, that is required for one washing operation.

It is preferable for the water-soluble wrapping to comprise polyvinyl alcohol or a polyvinyl alcohol copolymer. Water-soluble wrappings comprising polyvinyl alcohol or a polyvinyl alcohol copolymer exhibit good stability and sufficiently high water solubility, in particular cold water solubility.

Suitable water-soluble films for producing the water-soluble wrapping are preferably based on a polyvinyl alcohol, or a polyvinyl alcohol copolymer, having a relative molar mass in the range from about 10,000 to about 1,000,000 gmol-1, preferably from about 20,000 to about 500,000 gmol-1, particularly preferably from about 30,000 to about 100,000 gmol-1, and in particular from about 40,000 to about 80,000 gmol-1.

The polyvinyl alcohol is typically produced by the hydrolysis of polyvinyl acetate since the direct synthesis pathway is not possible. The same applies to polyvinyl alcohol copolymers produced accordingly from polyvinyl acetate copolymers. It is preferred if at least one layer of the water-soluble wrapping comprises a polyvinyl alcohol having a degree of hydrolysis of about 70 to about 100 mole %, preferably about 80 to about 90 mole %, particularly preferably about 81 to about 89 mole %, and in particular about 82 to about 88 mole %.

Additionally, a polymer selected from the group consisting of (meth)acrylic acid-containing (co)polymers, polyacrylamides, oxazoline polymers, polystyrene sulfonates, polyurethanes, polyesters, polyethers, polylactic acid or mixtures of the above polymers can be added to a polyvinyl alcohol-containing film material that is suitable for producing the water-soluble wrapping. A preferred additional polymer is polylactic acids.

In addition to vinyl alcohol, preferred polyvinyl alcohol copolymers comprise dicarboxylic acids as further monomers. Suitable dicarboxylic acids are itaconic acid, malonic acid, succinic acid and mixtures thereof, itaconic acid being preferred.

Likewise preferred polyvinyl alcohol copolymers include an ethylenically unsaturated carboxylic acid, the salt thereof, or the ester thereof, in addition to vinyl alcohol. In addition to vinyl alcohol, such polyvinyl alcohol copolymers particularly preferably comprise acrylic acid, methacrylic acid, acrylic acid esters, methacrylic acid esters or mixtures thereof.

It may be preferred for the film material to contain further additives. For example, the film material may contain plasticizers such as dipropylene glycol, ethylene glycol, diethylene glycol, propylene glycol, glycerol, sorbitol, mannitol or mixtures thereof. Examples of further additives include release aids, fillers, cross-linking agents, surfactants, antioxidants, UV absorbers, anti-blocking agents, non-stick agents or mixtures thereof.

Suitable water-soluble films for use in the water-soluble wrappings of the water-soluble packagings as contemplated herein are films sold by MonoSol LLC, for example, by the designation M8630, C8400 or M8900. Other suitable films include films by the designation Solublon® PT, Solublon® GA, Solublon® KC or Solublon® KL from Aicello Chemical Europe GmbH, or the VF-HP films from Kuraray.

Exemplary formulations of the agents according to the disclosure include both phosphate-containing and phosphate-free dishwasher detergents. Exemplary formulations in which the metal complexes described herein can be used in the indicated amounts as an additional component are as follows:

TABLE 1

Phosphate-containing solid dishwasher detergent formulation (Tab):

| Raw material | Amount (wt. %) |
|---|---|
| Phosphate (such as TPP) | about 18.00-about 45.00 |
| Na citrate/citric acid | 0.00-about 10.00 |
| Phosphonate (such as HEDP) | 0.00-about 2.00 |
| Silicate | 0.00-about 6.00 |
| Soda | about 12.00-about 20.00 |
| Na percarbonate | about 10.00-about 16.00 |
| Bleach catalyst | about 0.01-about 0.10 |
| TAED | about 1.00-about 2.70 |
| Non-ionic surfactant | about 2.00-about 8.00 |
| Polyacrylate | 0.00-about 5.00 |
| Sulfo polymer | about 5.00-about 10.00 |
| Cationic acrylate copolymer | 0.00-about 5.00 |
| PEG 4000 powder | 0.00-about 2.00 |
| Protease | about 0.50-about 7.00 |
| Amylase | about 0.10-about 2.50 |
| Benzotriazole (silver protection) | about 0.20-about 0.50 |
| Perfume | about 0.05-about 0.20 |
| Dye | about 0.50-about 2.00 |
| Zn acetate, anhydrous | about 0.15-about 0.35 |
| Na sulfate | 0.00-about 10.00 |

TABLE 2

Phosphate-free solid dishwasher detergent formulation (Tab):

| Raw material | Amount (wt. %) | g/job |
|---|---|---|
| Na citrate/citric acid | about 10.00-about 20.00 | about 3.00-about 4.00 |
| Phosphonate (such as HEDP) | 0.00-about 7.50 | 0.00-about 1.50 |
| MGDA/GLDA | about 5.00-about 35.00 | about 1.00-about 5.00 |
| Silicate | about 5.00-about 35.00 | about 2.00-about 7.00 |
| Soda | about 12.50-about 35.00 | about 2.50-about 5.00 |
| Na percarbonate | about 10.00-15.00 | about 2.00-about 3.00 |
| Bleach catalyst | about 0.02-about 0.50 | about 0.003-about 0.10 |
| TAED | about 2.00-about 3.00 | about 0.40-about 0.60 |
| Non-ionic surfactant | about 2.50-about 10.00 | about 0.50-about 2.00 |
| Polycarboxylate | about 5.00-about 10.00 | about 1.00-about 2.00 |
| Cationic acrylate copolymer | about 0.25-about 0.75 | about 0.05-about 0.15 |
| PVP (cross-linked) | 0.00-about 1.50 | 0.00-about 0.30 |
| Protease | about 1.50-about 5.00 | about 0.30-about 1.00 |
| Amylase | about 0.50-about 3.00 | about 0.10-about 0.60 |
| Benzotriazole (silver protection) | 0.00-about 0.50 | 0.00-about 0.10 |
| Perfume | about 0.05-about 0.15 | about 0.01-about 0.03 |
| Dye | 0.00-about 1.00 | 0.00-about 0.20 |
| Zn acetate, anhydrous | about 0.10-about 0.30 | about 0.02-about 0.06 |
| Na sulfate | 0.00-about 25.00 | 0.00-about 5.00 |
| Water | 0.00-about 1.50 | 0.00-about 0.30 |
| pH setting agent | about 1.00-about 1.50 | about 0.02-about 0.30 |
| Process auxiliary | 0.00-about 5.00 | 0.00-about 1.00 |

Preferably, tablets of about 17 to about 20 g are produced, wherein about 20 g tablets are preferred.

The present disclosure also relates to the corresponding use of the automatic dishwasher detergents as contemplated herein. The present disclosure furthermore relates to a dishwashing method, and in particular to an automatic dishwashing method, in which a dishwasher detergent as contemplated herein is used. The present application thus furthermore relates to a method for cleaning dishes in a dishwasher in which the agent according to the present disclosure is dispensed into the interior of a dishwasher while a dishwashing program is being executed, before the main washing cycle begins, or in the course of the main washing cycle. Dispensing or introduction of the agent as contemplated herein into the interior of the dishwasher can take place manually, but preferably the agent is dispensed into the interior of the dishwasher by means of the dosing chamber.

The embodiments described in context with the agents as contemplated herein can be readily applied to the methods and uses according to the present disclosure, and vice versa.

EXAMPLES

Example 1: Synthesis of N-mono-dodecyl Cyclen 1,4,7,10-tetraazacyclodecane (about 1 g, about 5.80 mmol) and triethylamine (about 0.24 mL, about 1.74 mmol) were dissolved in about 20 mL freshly distilled chloroform. 1-bromododecane (about 0.35 mL, about 1.45 mmol) was added in a portion to the solution, and the reaction solution was stirred for about 15 hours under reflux. Thereafter, the reaction solution was cooled to about room temperature and washed 3 times, each time with 7 about mL NaOH solution (about 1 M). The organic phase was washed 3 times, each time with about 10 mL distilled water, dried with magnesium sulfate, filtered, and the solvent was removed at reduced pressure. The product N-mono-dodecyl cyclen was obtained as a colorless oil (about 0.49 g, about 1.44 mmol; yield about 99%).

Analogously to this C12 cyclen, additional ones, such as C8 cyclen or C16 cyclen, were synthesized using the corresponding bromoalkanes.

Example 2: Synthesis of the Zinc Complex of N-mono-dodecyl Cyclen

N-mono-dodecyl cyclen (about 0.5 g, about 1.47 mmol) was dissolved in about 10 mL distilled water and heated to about 65° C. Zinc sulfate (about 422 mg, about 1.47 mmol), dissolved in about 4 mL distilled water, was slowly added dropwise to the milky-white solution. The clear, colorless reaction solution was stirred for about 20 hours at about 65° C., then hot-filtered, and cooled to about room temperature. The cooled solution was freeze-dried so as to obtain the zinc complex of N-mono-dodecyl cyclen (about 0.51 g, about 1.02 mmol, yield about 70%).

Analogously, in addition to C12 cyclen zinc, the further zinc complexes C8 cyclen ink and C16 cyclen ink were also produced.

The described cyclen compounds are shown hereafter with the chemical formulas thereof:

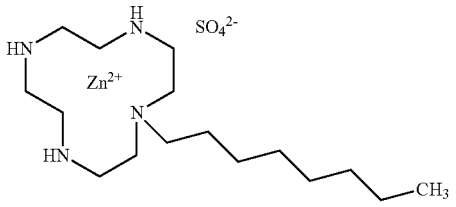

C8 cyclen zinc

-continued

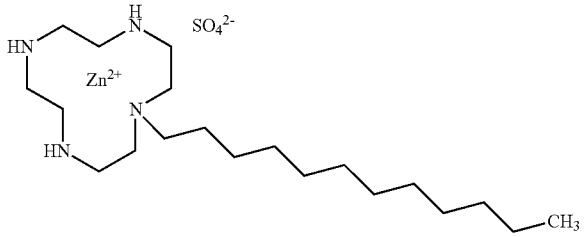

C12 cyclen zinc

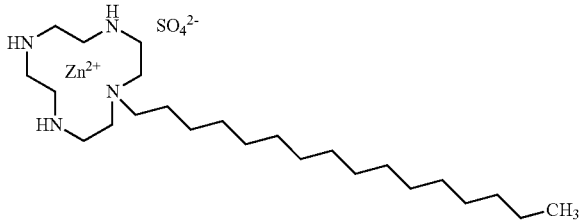

C16 cyclen zinc

Example 3: Synthesis of the Copper Complex of N-mono-dodecyl Cyclen

N-mono-dodecyl cyclen (about 0.49 g, about 1.44 mmol) was dissolved in about 10 mL distilled water and heated to about 65° C. Copper(II) sulfate (about 230 mg, about 1.44 mmol), dissolved in about 4 mL distilled water, was slowly added dropwise to the milky-white solution. The clear, dark blue reaction solution was stirred for about 20 hours at about 65° C., then hot-filtered, and cooled to room temperature. The cooled solution was freeze-dried so as to obtain the copper complex of N-mono-dodecyl cyclen (about 0.71 g, about 1.42 mmol, yield about 99%).

Example 4: Cleaning Performance

In addition to a phosphate-free base recipe according to Table 2, the following additional agents were formulated:

TABLE 3

| Phosphate-containing dishwasher detergent tablet | |
|---|---|
| Tab Formulation | |
| Tripolyphosphate (wt. %) | about 35.9 |
| Sodium carbonate (wt. %) | about 12.2 |
| Phosphonate (wt. %) | about 2.4 |
| Sulfonic acid group-containing polymer (wt. %) | about 7.0 |
| Polyacrylate (wt. %) | about 4.6 |
| Non-ionic surfactants (wt. %) | about 6.1 |
| Percarbonate (wt. %) | about 14.6 |
| TAED (wt. %) | about 2.3 |
| Bleach catalyst (wt. %) | about 0.01 |
| PVP (wt. %) | about 1.5 |
| Sodium silicate (wt. %) | about 3.0 |
| Protease (wt. %) | about 3.0 |
| Amylase (wt. %) | about 1.0 |
| Zinc acetate (wt. %) | about 0.2 |
| Remainder (perfume, dyes, and the like) (wt. %) | to make up to about 100 |

TABLE 4

| Phosphate-free liquid formulation in a pouch | |
|---|---|
| | % AS |
| GLDA tetrasodium salt | about 18.80 |
| Glycerol | about 2.50 |
| Sulfo polymer | about 5.50 |
| Polyacrylate | about 2.70 |
| Citric acid | about 5.00 |
| HEDP | about 0.60 |
| Monoethanolamine | about 3.60 |
| Non-ionic surfactant | 3.00 |
| Cationic rinse-aid polymer | about 0.19 |
| Amylase (wt. % active enzyme) | about 0.0125 |
| Protease (wt. % active enzyme) | about 0.2 |
| Auxiliaries, such as perfume, dye, bittering agent, preservative, thickener | about 1.25 |
| Water | to make up to about 100 about 100.00 |

The cleaning performance was determined in Miele dishwashers using the 50° C. program. Water hardness about 21° dH. For this purpose, about 20 g of the phosphate-containing solid recipe (Tab) shown in Table 3 was used in combination with about 0.1 g C12 cyclen zinc (E1) or about 20 g of the phosphate-free liquid recipe (Pouch) shown in Table 4 was used in combination with about 0.1 g of the copper complex from Example 3 (E2). In comparative experiments, about 0.1 g zinc sulfate heptahydrate (V3), about 0.1 g copper(II) sulfate (V4), or about 0.1 g N-mono-dodecyl cyclen (V2) was used in combination with about 20 g of the above dishwasher detergent recipes, or the recipe was used without any additives (V1).

After the washing cycle was completed, the dishes were visually inspected based on a scale of 1 to 10. The higher the value, the better the cleaning performance. It is apparent that, compared to the comparative recipes, the recipes according to the present disclosure show improved cleaning performance with respect to burnt-on creme brulee soiling (Table 2).

TABLE 5

| Cleaning performance | |
|---|---|
| ADW Product | Creme brulee |
| Zinc complex test series | |
| V1 | about 2.8 |
| V2 | about 2.0 |

TABLE 5-continued

| Cleaning performance | |
|---|---|
| ADW Product | Creme brulee |
| V3 | about 1.8 |
| E1 | about 3.8 |
| Copper complex test series | |
| V1 | about 5.5 |
| V2 | about 6.2 |
| V3 | about 6.4 |
| E2 | about 6.8 |

In further experiments, about 0.1 g of one of the zinc complexes shown in Example 2, C8 cyclen zinc, C12 cyclen zinc and C16 cyclen zinc, was additionally dosed to about 20 g of the recipe from Table 2 (phosphate-free Tab) (E3 to E5). The cleaning performance was again determined in Miele domestic dishwashers using the 50° program (water hardness about 21° dH). As before, the dishes were visually inspected after the washing cycle based on a scale of 1 to 10. The higher the value, the better the cleaning performance.

TABLE 6

| | Product | Tea (Assam) | Ground beef (about 130° C.) | Egg yolk about 1.5 g | Spaghetti | Starch | Creme brulee |
|---|---|---|---|---|---|---|---|
| V4 | Tab P-free (Table 2) | about 4.5 | about 4.3 | about 4.3 | about 3.4 | about 7.9 | about 6.2 |
| E3 | Tab P-free + about 0.1 g $C_8$ cyclen Zn | about 5.3 | about 5.0 | about 5.2 | about 4.7 | about 8.6 | about 7.2 |
| E4 | Tab P-free + about 0.1 g $C_{12}$ cyclen Zn | about 4.5 | about 4.8 | about 4.6 | about 3.3 | about 7.5 | about 6.4 |
| E5 | Tab P-free + about 0.1 g $C_{16}$ cyclen Zn | about 3.5 | about 4.0 | about 3.8 | about 3.2 | about 7.1 | about 6.4 |

It is apparent that E3, compared to the standard V4 and to E4 and E5, results in improved cleaning performance with respect to tea (Assam), ground beef (about 130° C.), egg yolk, spaghetti, starch, and creme brulee soiling. The cleaning performance decreases from C8 cyclen Zn, through C12 cyclen Zn, to C16 cyclen Zn, which is to say the longer the alkyl chain on the cyclen, the poorer is the performance. Additionally, E3 is better than the standard on each of the tested soiling types.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the various embodiments in any way. Rather, the foregoing detailed description will provide those skilled in the art with a convenient road map for implementing an exemplary embodiment as contemplated herein. It being understood that various changes may be made in the function and arrangement of elements described in an exemplary embodiment without departing from the scope of the various embodiments as set forth in the appended claims.

The invention claimed is:

1. A dishwasher detergent comprising: based on the total weight of the dishwasher detergent, about 0.001 to about 10.0 wt. % of at least one metal complex of formula (I)

$$M^{n+}L(A^{m-})_{n/m} \quad (I)$$

wherein

M is a metal cation;

A is an arbitrary anion;

n and m are integers selected from 1 to 6; and

L is a neutral ligand of formula (II)

(II)

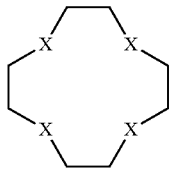

wherein each X is independently O or NR; and each R is independently selected from H, unsubstituted or substituted, linear or branched $C_{1-20}$ alkyl, unsubstituted or substituted, linear or branched $C_{1-20}$ heteroalkyl, unsubstituted or substituted, linear or branched $C_{2-20}$ alkenyl, unsubstituted or substituted, linear or branched $C_{2-20}$ heteroalkenyl, and unsubstituted or substituted, linear or branched $C_{2-20}$ alkynyl.

2. The dishwasher detergent according to claim 1, wherein A is selected from the group consisting of $F^-$, $Cl^-$, $Br^-$, $I^-$, $OH^-$, $HSO_3^-$, $SO_3^{2-}$, $SO_4^{2-}$, $HSO_4^-$, $NO_2^-$, $NO_3^-$, $PO_4^{3-}$, $HPO_4^{2-}$, $H_2PO_4^-$, $PF_6^-$, $ClO_4^-$, acetate, citrate, formate, glutarate, lactate, malate, malonate, oxalate, pyruvate, tartrate, methanesulfonate, methyl sulfate, tosylate, and succinate.

3. The dishwasher detergent according to claim 1, wherein R in formula (II) is selected from H, unsubstituted or substituted, linear or branched $C_{1-20}$ alkyl and unsubstituted or substituted, linear or branched $C_{1-20}$ heteroalkyl.

4. The dishwasher detergent according to claim 1, wherein (i) at least one X; and/or (ii) at least one R is H, and at least one R is a linear $C_{8-18}$ alkyl functional group or $C_{2-18}$ heteroalkyl functional group.

5. The dishwasher detergent according to claim 1, wherein (i) at least one X is NR; and/or (ii) at least one R is H, and at least one R is $—(CH_2)_oCH_3$, wherein o is an integer selected from 5 to 9.

6. The dishwasher detergent according to claim 1, wherein the ligand of formula (II) is an N-substituted cyclen (1,4,7,10-tetraazacyclododecane), and the metal cation is $Zn^{2+}$.

7. The dishwasher detergent according to claim 6, wherein the ligand of formula (II) is an N-substituted cyclen (1,4,7,10-tetraazacyclododecane), the metal cation is $Zn^{2+}$, and the anion is $SO_4^{2-}$.

8. The dishwasher detergent according to claim 1, wherein the dishwasher detergent comprises at least one further component selected from the group consisting of surfactants, builders, enzymes, thickeners, sequestering agents, electrolytes, corrosion inhibitors, glass corrosion inhibitors, suds suppressors, dyes, fragrances, bittering agents, antimicrobial active ingredients and disintegration auxiliaries.

9. An automatic dishwashing method, comprising:

dispensing a dishwasher detergent according to claim 1 into the interior of a dishwasher while a dishwashing program is being executed, before the main washing cycle begins, or in the course of the main washing cycle.

10. A dishwasher detergent comprising: based on the total weight of the dishwasher detergent, about 0.001 to about 10.0 wt. % of at least one metal complex of formula (I)

$$M^{n+}L(A^{m-})_{n/m} \quad (I)$$

wherein

M is a metal cation;

A is an arbitrary anion;

n and m are integers selected from 1 to 5; and

L is a neutral ligand of formula (II)

(II)

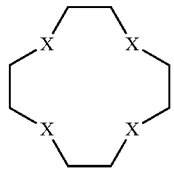

wherein each X is independently O or NR; and each R is independently selected from H, $—(CH_2)_o—CH_3$, wherein o is an integer selected from 3 to 13, $—(CH_2)_p—COOH$ and $—(CH_2)_p—OH$, wherein p is a respective integer selected from 1 to 6.

11. The dishwasher detergent according to claim 10, wherein A is selected from the group consisting of $F^-$, $Cl^-$, $Br^-$, $I^-$, $OH^-$, $HSO_3^-$, $SO_3^{2-}$, $SO_4^{2-}$, $HSO_4^-$, $NO_2^-$, $NO_3^-$, $PO_4^{3-}$, $HPO_4^{2-}$, $H_2PO_4^-$, $PF_6^-$, $ClO_4^-$, acetate, citrate, formate, glutarate, lactate, malate, malonate, oxalate, pyruvate, tartrate, methanesulfonate, methyl sulfate, tosylate, and succinate.

12. The dishwasher detergent according to claim 10, wherein R in formula (II) is selected from H, unsubstituted or substituted, linear or branched $C_{1-20}$ alkyl and unsubstituted or substituted, linear or branched $C_{1-20}$ heteroalkyl.

13. The dishwasher detergent according to claim 10, wherein (iii) at least one X; and/or (iv) at least one R is H, and at least one R is a linear $C_{8-18}$ alkyl functional group or $C_{2-18}$ heteroalkyl functional group.

14. The dishwasher detergent according to claim 10, wherein (iii) at least one X is NR; and/or (iv) at least one R is H, and at least one R is $—(CH_2)_oCH_3$, wherein o is an integer selected from 5 to 9.

15. The dishwasher detergent according to claim 10, wherein the ligand of formula (II) is an N-substituted cyclen (1,4,7,10-tetraazacyclododecane), and the metal cation is $Zn^{2+}$.

* * * * *